US007216936B2

(12) United States Patent
Peterson

(10) Patent No.: US 7,216,936 B2
(45) **Date of Patent: *May 15, 2007**

(54) CUSHION CONSTRUCTION FOR SEATING UNIT

(75) Inventor: Gordon J. Peterson, Rockford, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/109,384

(22) Filed: Apr. 19, 2005

(65) Prior Publication Data

US 2005/0206212 A1 Sep. 22, 2005

Related U.S. Application Data

(60) Continuation of application No. 10/136,599, filed on May 1, 2002, now Pat. No. 6,880,215, which is a division of application No. 09/294,665, filed on Apr. 19, 1999, now Pat. No. 6,425,637.

(51) Int. Cl.
*A47C 7/00* (2006.01)

(52) U.S. Cl. ..... 297/440.2; 297/284.4

(58) Field of Classification Search ..... 297/440.2, 297/284.4

See application file for complete search history.

(56) References Cited

U.S. PATENT DOCUMENTS

| | | | |
|---|---|---|---|
| 3,700,282 | A | 10/1972 | Rowland |
| 3,747,977 | A | 7/1973 | Rowland |
| 3,762,766 | A | 10/1973 | Barecki et al. |
| 3,823,980 | A | 7/1974 | Harnick |
| 4,065,181 | A | 12/1977 | Gunlock et al. |
| 4,556,254 | A | 12/1985 | Roberts |
| 4,792,189 | A | 12/1988 | Shovar |
| 4,836,609 | A | 6/1989 | Hill |
| 4,946,220 | A | 8/1990 | Wyon et al. |
| 5,067,772 | A | 11/1991 | Koa |
| 5,169,580 | A | 12/1992 | Marcus |
| 5,194,311 | A | 3/1993 | Baymak et al. |
| 5,294,392 | A | 3/1994 | Marcus |
| 5,298,321 | A | 3/1994 | Isoda et al. |
| 5,318,346 | A | 6/1994 | Roossien et al. |
| 5,345,661 | A | 9/1994 | Hotton et al. |
| 5,399,423 | A | 3/1995 | McCullough et al. |
| 5,407,739 | A | 4/1995 | McCullough et al. |
| 5,426,801 | A | 6/1995 | Klearman et al. |
| 5,457,864 | A | 10/1995 | Sakaida |
| 5,489,351 | A | 2/1996 | Yoshida et al. |
| 5,492,662 | A | 2/1996 | Kargol et al. |
| 5,494,627 | A | 2/1996 | Kargol et al. |
| 5,505,815 | A | 4/1996 | Yoshida et al. |

(Continued)

*Primary Examiner*—Anthony D. Barfield
(74) *Attorney, Agent, or Firm*—Price, Heneveld, Cooper, DeWitt & Litton LLP

(57) ABSTRACT

A method of manufacturing a seating unit, such as a chair, includes manufacturing a cushion made from a non-woven fibrous material, and attaching the cushion to the seating unit for comfortable support. The cushion is made by cutting a blank from non-woven fibrous sheet material, steam-forming the blank into a pre-formed cushion shaped to support a user, and attaching a stiffener panel to the pre-formed cushion to provide a stiffened cushion assembly. The cushion assembly is aesthetically covered and assembled to seating unit. Advantageously, trimmings from the fibrous material can be recycled.

20 Claims, 8 Drawing Sheets

U.S. PATENT DOCUMENTS 5,551,755 A 9/1996 Lindberg
5,586,377 A 12/1996 Katsuta et al.
5,614,296 A 3/1997 Travelute et al.
5,639,543 A 6/1997 Isoda et al.
5,718,478 A 2/1998 Allison
5,750,246 A 5/1998 Yuasa et al.
5,842,264 A 12/1998 Roossien et al.
5,850,645 A 12/1998 Ogawa et al.
5,871,258 A 2/1999 Battey et al.
5,975,634 A 11/1999 Knoblock et al.
6,003,950 A 12/1999 Larsson
6,062,649 A * 5/2000 Nagel et al. ..... 297/440.2 X
6,082,824 A 7/2000 Chow
6,109,688 A 8/2000 Wurz et al.
6,131,221 A 10/2000 Yang
6,210,147 B1 4/2001 Mori et al.
6,213,557 B1 4/2001 Aebischer et al.

* cited by examiner

CUSHION CONSTRUCTION FOR SEATING UNIT

CROSS REFERENCES TO RELATED APPLICATION

This application is a continuation of patent application Ser. No. 10/136,599, filed May 1, 2002, entitled METHOD OF MANUFACTURING CUSHION CONSTRUCTION FOR SEATING UNIT (now U.S. Pat. No. 6,880,215), which is a divisional of commonly assigned, co-invented application Ser. No. 09/294,665, filed Apr. 19, 1999, entitled CUSHION CONSTRUCTION FOR FURNITURE (now U.S. Pat. No. 6,425,637).

BACKGROUND OF THE INVENTION

The present invention relates to methods of manufacturing cushion constructions for seating, where the cushion has improved cushioning properties.

Chairs having upholstery covered cushions on their seat and backs are known. The cushions provide a cushioning effect that conforms at least somewhat to a seated user's body to provide increased comfort. A common cushion in chairs is a polyurethane open-celled foam cushion that is pre-formed to an initial shape. For example, U.S. Pat. No. 4,718,153, to Armitage et al., issued Jan. 12, 1998, entitled Cushion Manufacturing Process, discloses one such cushion manufacturing process utilizing a polyurethane foam. A problem is that the polyurethane will degrade over time, leading to breakdown of the polyurethane foam that generates dust and a degradation of cushioning properties. The dust and breakdown potentially adds to environment dust in the building where the chair is located. Also, the breakdown and loss of material results in changes to the cushioning support provided by the cushion. Polyurethane foam cushions also suffer from other disadvantages. Polyurethane foam is not recyclable, leading to increased landfill costs when scrap is generated. Further, the polyurethane foam typically has a pinched-off edge or weld line of higher density material running around its perimeter. The higher density material can cause quality problems, both in terms of poor appearance due to its roughness, stiffness, and protruding nature, and also in terms of an unattractive bumpy feel when a person sits on or feels the fabric covering the higher density material. Still another problem is caused when a seated user sweats against a polyurethane foam cushion, because the polyurethane foam cushions are sometimes not able to wick away the sweat (or at least not fast enough), depending on the foam and the volume of sweat.

Accordingly, an improved cushion construction for furniture is desired that solves the aforementioned problems and has the aforementioned advantages.

SUMMARY OF THE INVENTION

One aspect of the present invention includes a seating unit having a base and a seat support supported by the base. A back upright is operably supported on the base for movement between an upright position and a reclined position. A back construction includes a back support attached to the back upright. A cushion is supported by a surface on one of the back support and the seat support, the cushion having opposing side edges. An edge stabilizer extends along the opposing side edges and is attached to the side edges to control a position of the side edges relative to the one back and seat support.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 2:
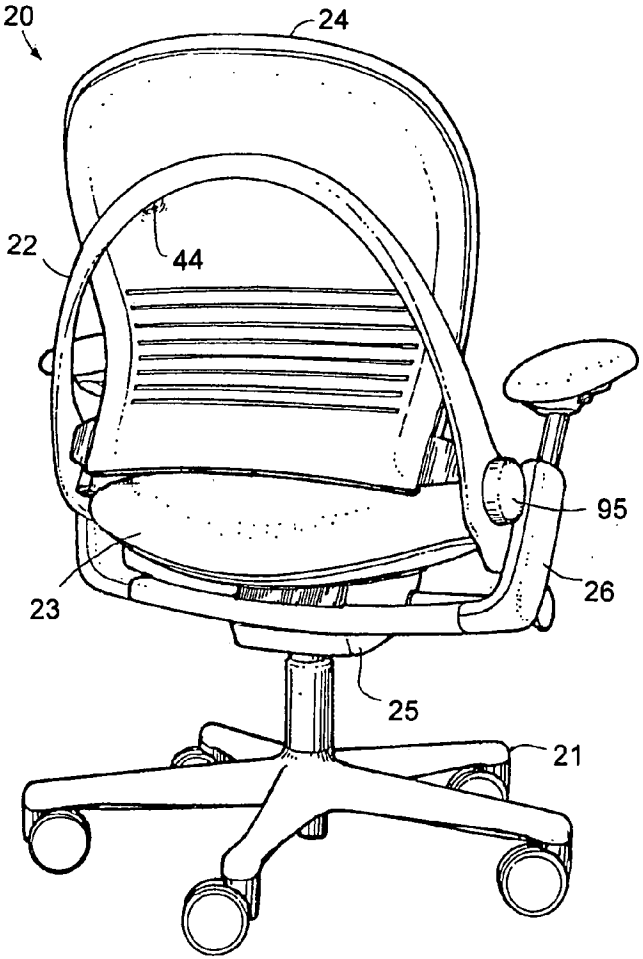
FIGS. 1 and 2 are front and rear perspective views of a chair embodying the present invention.
Figure 1:
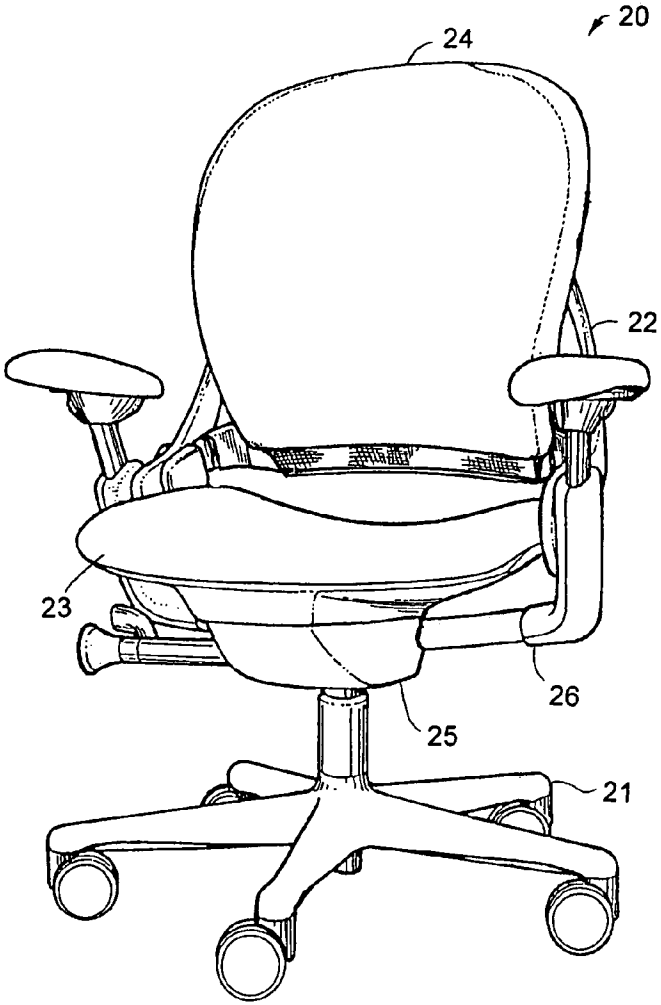
Figure 8:
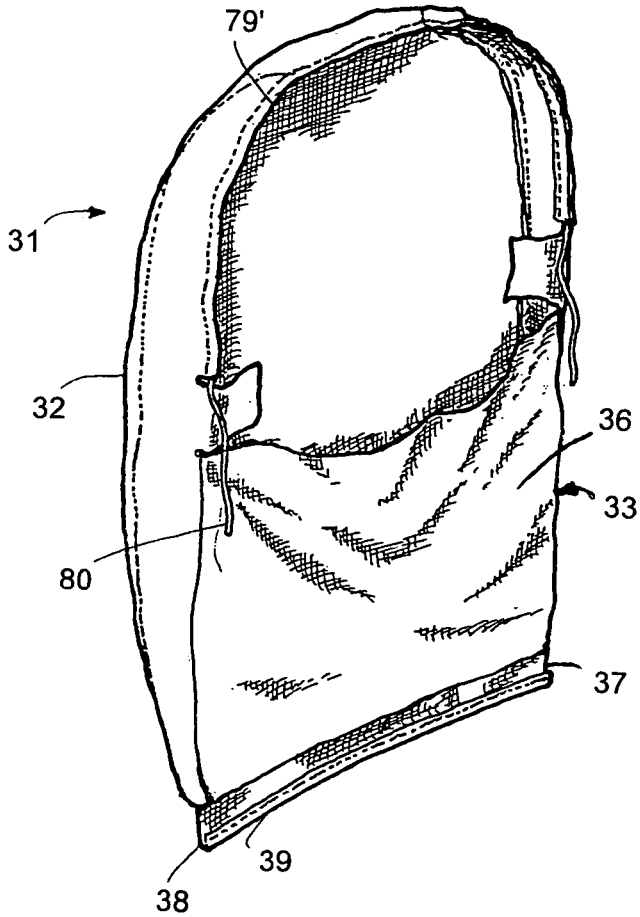
FIG. 8 is a perspective view of the cover assembly shown in FIG. 3.

A chair 20 (FIGS. 1 and 2) embodying the present invention includes a base 21, a back upright or arch-shaped back frame 22, a seat 23, and a back construction 24. The base 21 includes a control housing 25 with fixed side support structures 26 extending laterally and upwardly from the control housing 25. The back upright 22 is movable between an upright position and a reclined position. The back construction 24 (FIG. 3) includes a back support shell 27 (also referred to as a "back support") attached to the back upright 22 (FIG. 4), and further includes a cushion assembly 28 (FIG. 3) attached to the back support shell 27 with quick-attach hooking top connection 29 and a "zip-lock" type bottom connection 30. The cushion assembly 28 includes a cover assembly 31 (FIG. 8) having an upholstery front panel 32 and a rear panel 33 forming a sock that can be inverted and "pulled" upwardly onto a cushion 35 and cushion stiffener 34 as the cover assembly 31 is inverted. The rear panel 33 includes a first sheet/fabric section 36 having a one-directional stretch in a vertical direction, and further includes a lower second fabric section 37 having a high-stretch property. The second section 37 hangs downwardly from the front panel 32 and has a strip of stiff material 38 sewn along its lower edge to form the stiffened edge flange 39 noted below, which stiffened edge flange 39 forms part of the bottom connection 30. The stretchable second section 37, in combination with the other structure of top and bottom connections 29 and 30, allow for quick assembly, yet provide for a tensioned cover assembly 31 on the back construction 24 that tends to remain flat and unwrinkled, even with considerable flexure of the back construction 24 in the lumbar region of the back construction 24.

The present description of chair 20 is believed to be sufficient for an understanding of the present combination. Nonetheless, it is noted that a more detailed description of the chair 20 can be found in U.S. Pat. No. 5,871,258, issued Feb. 16, 1999, entitled Chair with Novel Seat Construction, and also in U.S. Pat. No. 5,975,634, issued Nov. 2, 1999, entitled Chair Including Novel Back Construction, the entire contents of both of which are incorporated herein in their entirety by reference. It is to be understood that a scope of the present invention includes using the present attachment and construction methods in combination with different office chairs, but also in many other chairs and seating units where upholstery covering is desired, such as in couches, lounge seating, mass transit seating, automotive or bus seating, and stadium seating, or also in other upholstery-covered furniture, such as padded desking furniture and the like, and also in non-furniture situations where upholstery or sheeting must be attached to a flexible or bendable component in a wrinkle-free manner.

Figure 3:
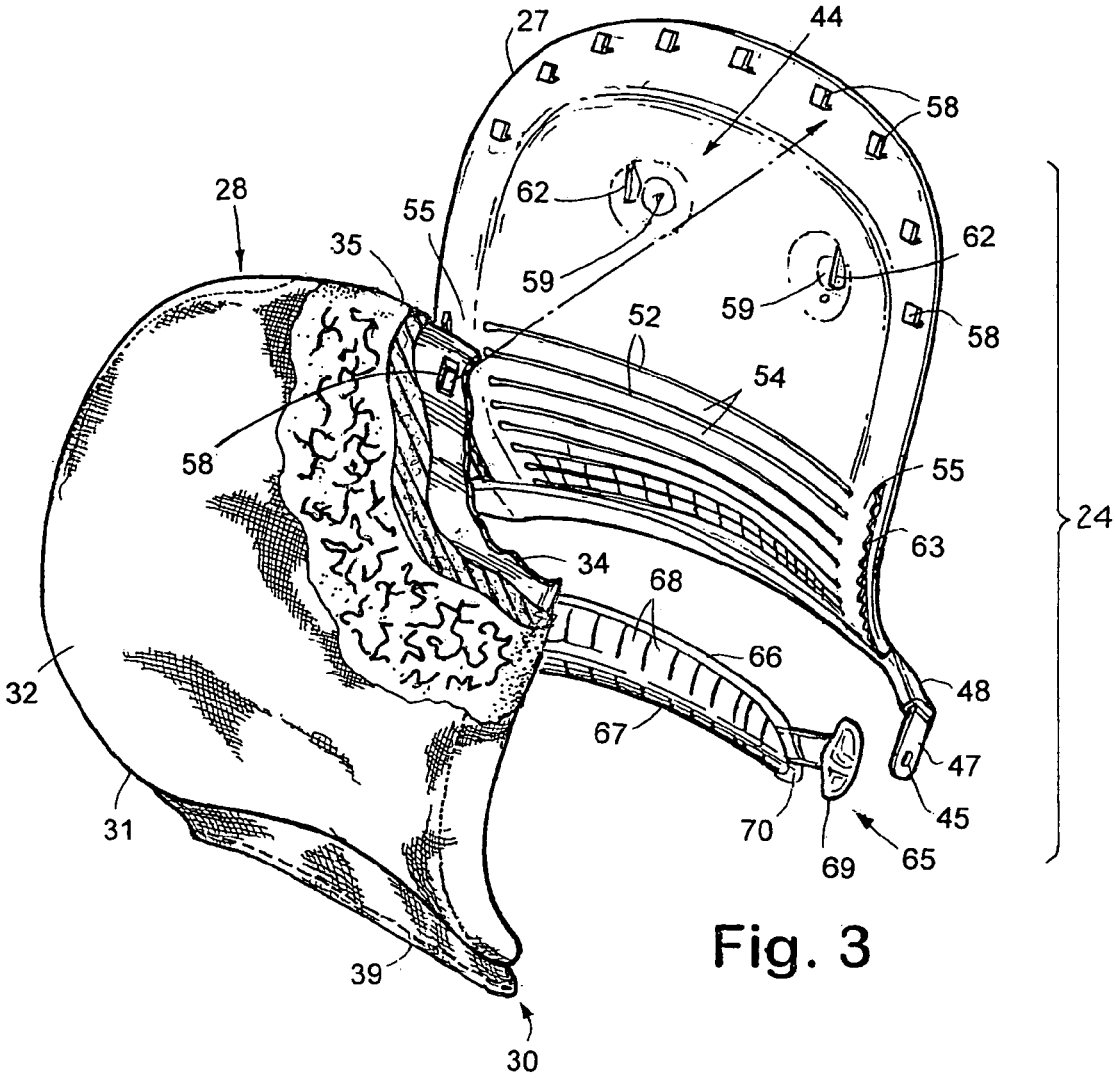
FIG. 3 is an exploded front perspective view of the back construction shown in FIG. 1.
Figure 4:
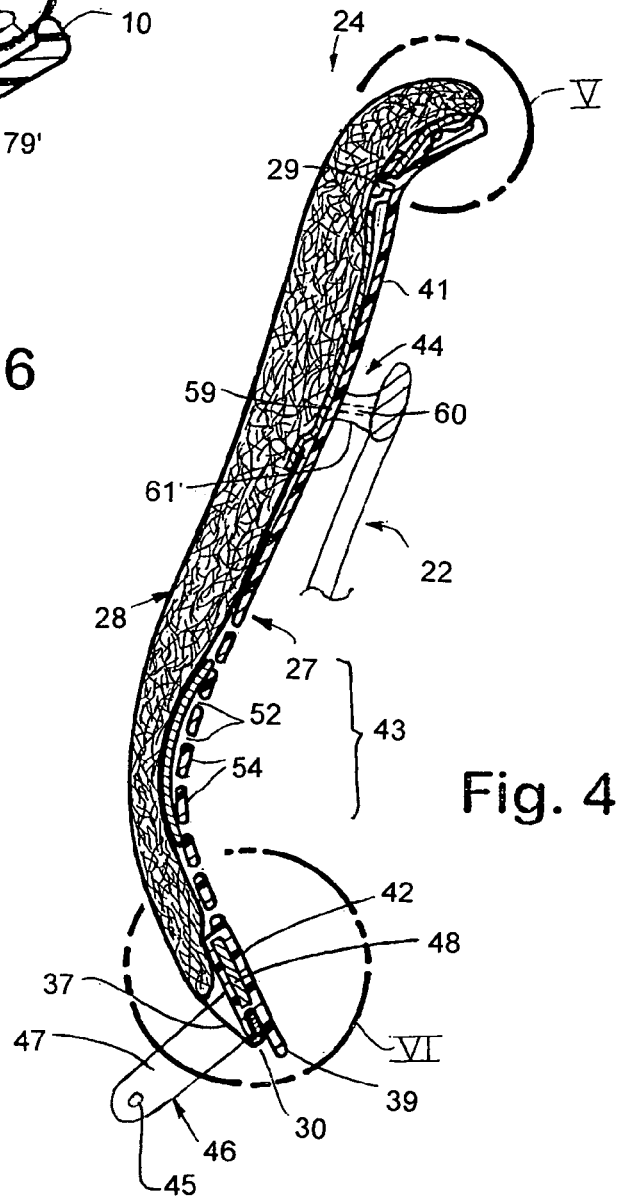
FIG. 4 is a vertical cross-sectional view taken through a center of the back construction shown in FIG. 1.

The back support shell 27 (FIG. 4) comprises a sheet of polypropylene material or similar engineering-type stiff structural material, and includes relatively stiff thoracic and pelvic sections 41 and 42 connected by a flexible lumbar section 43. The back support shell 27 is relatively stiff in a plane defined by the sheet, but is flexible in the lumbar section 43 in a direction perpendicular to the sheet. The thoracic and pelvic sections 41 and 42 are attached to the back frame 22 at top and bottom pivot locations 44 and 45, and the lumbar section 43 protrudes forwardly from the thoracic and pelvic sections 41 and 42. A belt bracket 46 extends parallel a lower edge of the pelvic section 42, and includes forwardly extending side flanges 47 each having a hole defining the bottom pivot location 45. The belt bracket 46 is encapsulated in an enlarged section 48 that extends along the lower edge of the pelvic section 42, and forms a horizontal recess 49 defined between a longer rear lip 50 and a shorter front lip 51. Slots 52 extend horizontally across a center area of the lumbar section 44 to form horizontal bands 54, but terminate short of the edges of the lumbar section 44 to define vertical side edge bands 55 (FIG. 3). The horizontal and vertical bands 54 and 55 are semi-flexible and designed to be sufficient in size and strength to provide the support desired. Due to the locations of top and bottom pivot locations 44 and 45 and also due to the shape and characteristics of the sections 41–43 and belt bracket 46, the back support shell 27 flexes significantly in the lumbar area, but rotates along a predetermined path a substantial amount around the bottom pivot location 45 and to a lesser extent around the top pivot location 44. This results is significant wrinkling of the upholstery material, unless the back construction 24 is constructed to compensate and make up for this high flexure, and the high compressing and stretching of the surfaces (i.e., the upholstery) in the lumbar section 43.

Figure 6:
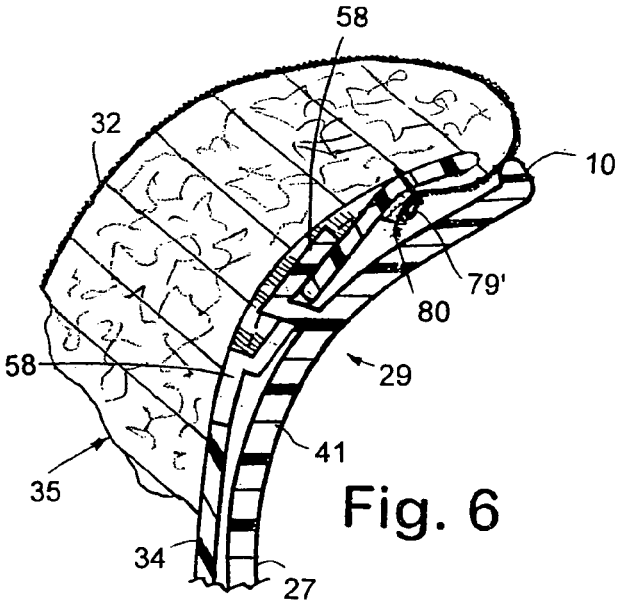
FIGS. 5 and 6 are enlarged views of the circled areas V and VI in FIG. 4.

The thoracic section 41 (FIG. 6) includes a ridge 57 along its upper edge and a series of hooks 58 spaced below the ridge 57 that project forwardly and then upwardly. A pair of apertures 59 is spaced below the hooks 58. The apertures 59 are positioned to receive screws 60 (FIG. 4) that extend rearwardly through the apertures 59 into threaded engagement with bosses 61 near a top of the arch-shaped back frame 22. The apertures 59 are recessed to create a rearwardly deformed pocket to receive a head of the screws 60 as desired. A pair of alignment stops 62' is located in the recesses on a front of the back support shell 27 adjacent apertures 59 to assist in assembly, as described below.

A pair of saw-tooth ridges 63 (FIG. 3) extends along a front face of the vertical bands 55 at a location near to but spaced inwardly from outer edges of the bands 55. A lumbar adjustment device 65 is positioned between the cushion assembly 28 and the back support shell 27. The lumbar adjustment device 65 includes a carrier 66, a lumbar support member 67 with vertical leaf-spring-like fingers 68 supported on the carrier 66, and a pair of side handles 69. The side handles 69 telescopingly engage mating structures 70 on ends of the carrier 66, and further include a channel for slidably engaging the saw-tooth ridges 63. A detent on the handles 69 engages the saw-tooth ridges 63 to hold the lumbar adjustment device in a selected vertical position.

Figure 7:
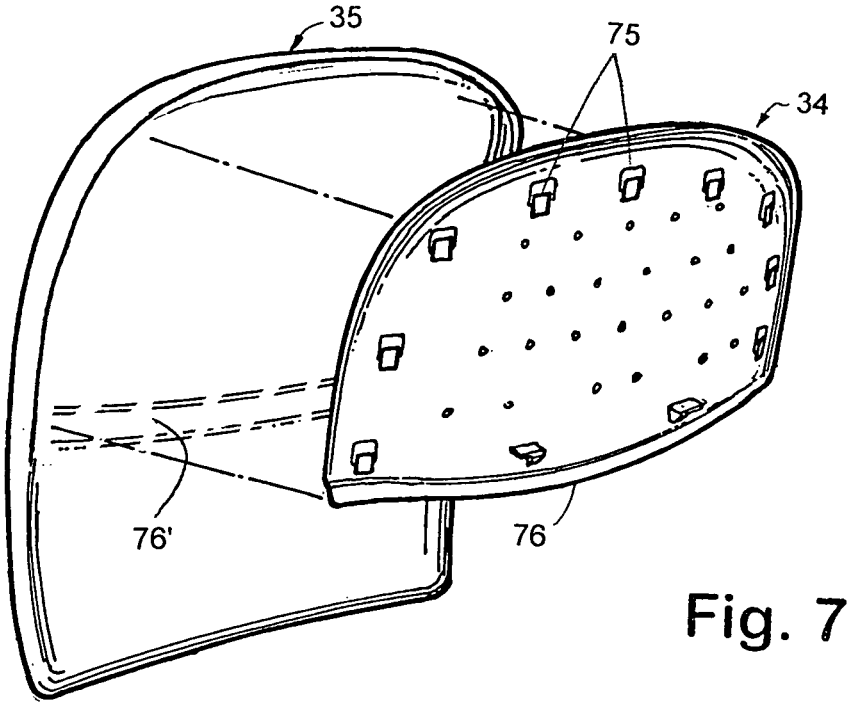
FIG. 7 is an exploded perspective view of the stiffened cushion subassembly shown in FIG. 3.

The cushion assembly 28 includes a back cushion 35 (FIG. 3) formed of non-woven PET fibers, as described below. The back cushion 35 provides an excellent initial support and feel to a seated user when he/she initially leans against the cushion assembly 28, even without use of a topper sheet commonly used in the seating industry. The cushion stiffener 34 comprises a stiff polypropylene panel. The cushion 35 includes a rear surface shaped to mateably receive the cushion stiffener 34. An upper edge 74 (FIG. 7) on a rear surface of the cushion 35 is wrapped over the upper edge 74 and onto a rear surface of the cushion stiffener 34. The cushion stiffener 34 is adhered to the cushion 35 if needed to maintain the stability of the assembly desired. The cushion stiffener 34 includes a series of spaced-apart apertures 75 that correspond to the hooks 58 (FIG. 3). A horizontal down flange 76 (FIG. 7) extends along a lower edge of the cushion stiffener 34, which flange 76 is deformed inwardly toward the cushion 35 at least a thickness of the material of rear panel 33, so that the rear panel 33 does not protrude outwardly when attached to the flange 76, as described below. The cushion 35 has a recess 76' that mateably engages the flange 76.

Figure 5:
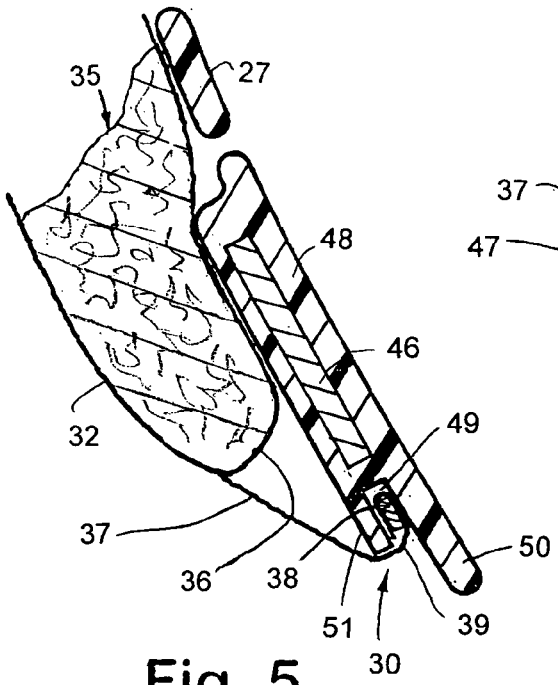

As noted above, the cover assembly 31 (FIG. 8) includes a front panel 32 and a rear panel 33. The front panel 32 includes sections of upholstery material sewn together to form the front and sides of a covering for the cushion 35. The rear panel 33 includes the first fabric section 36, which comprises a material that stretches horizontally only about five percent (5%), but that stretches vertically about forty percent (40%). The one-directional stretch material is available in commerce, such as from Milliken Company, Spartanburg, S.C. This first fabric section 36 is sized to extend from the mid-level horizontal flange 76 on the cushion stiffener 34 downwardly to a bottom of the cushion 35. The second section 37 is a high-stretch material having a stretchability of about one hundred percent (100%). This second section 37 is about two inches high and extends across a bottom of the rear panel 33 of the cover assembly 31. A strip of stiffener material 78, such as polypropylene, is about ¼-inch wide in a vertical direction and is placed along a lower edge of the second section 37. The lower edge is folded over the strip 78 and sewn to the lower edge. This forms a stiffened edge flange 79 horizontally across the second section 37 that is optimally suited to be pressed or "zipped" into and frictionally retained in the horizontal recess 49 with a zip-lock like motion (see FIG. 5). Notably, the stiffened edge flange 79 is rectangular in shape and is rolled forwardly 180 degrees before it is inserted into the recess 49 (FIG. 5). This results in a surprisingly positive and secure bottom connection arrangement and one that can be quickly made by an assembler. The top rear edge of the front panel 32 (FIG. 6) is folded and sewn to form a tunnel 79', and a drawstring 80 is located in the tunnel. The front and rear panels 32 and 33 are sewn together to form an upwardly open sock. The panels 32 and 33 are initially sewn in an inverted position, and the cushion 35 is inserted into the sock as the sock in inverted. This also hides the seam lines where the panel 32 and first and second fabric sections 36 and 37 are sewn together.

Figure 9:
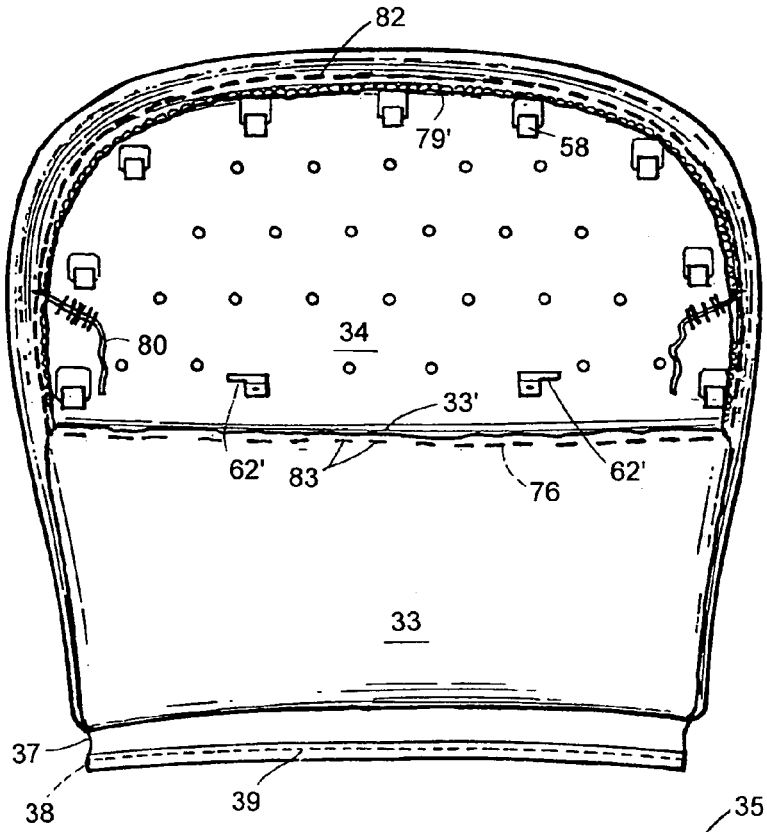
FIG. 9 is a rear view of the cushion assembly shown in FIG. 3, including the stiffened cushion subassembly and the cover assembly.
Figure 10:
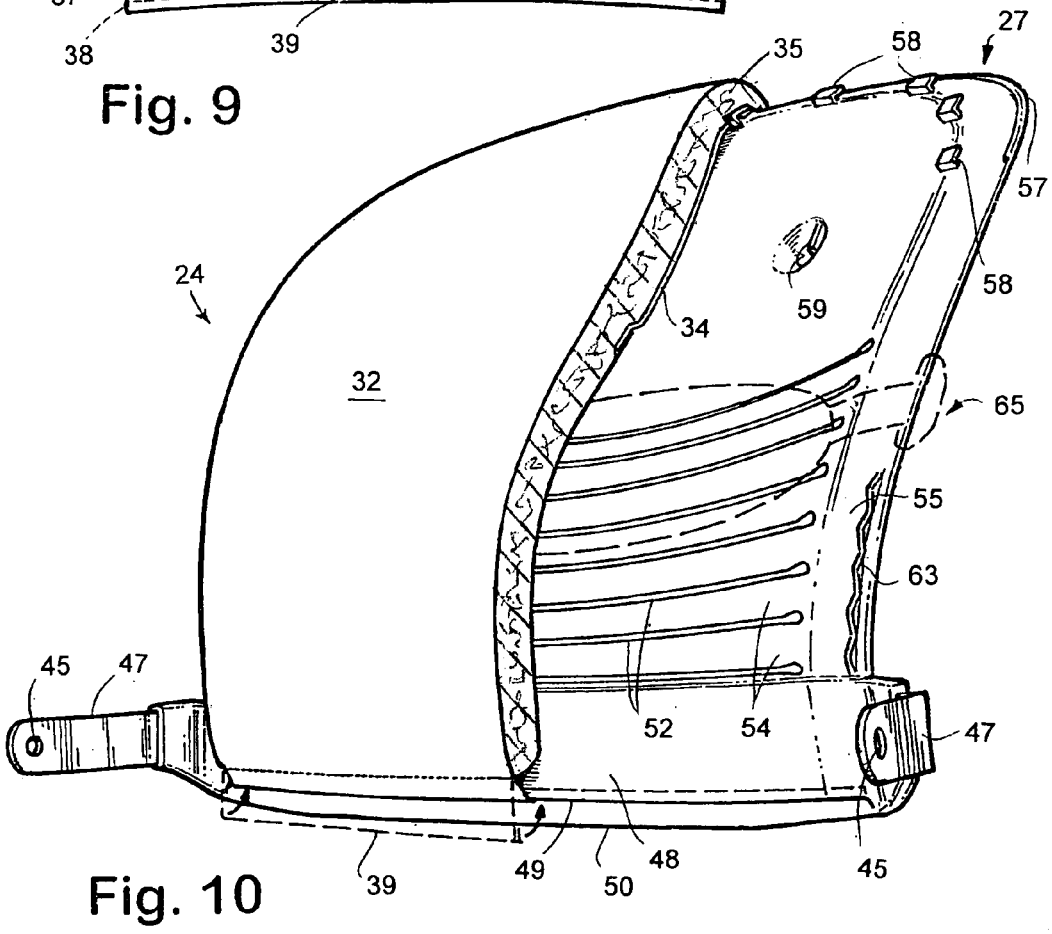
FIG. 10 is a front perspective view, partially broken away, showing the back construction of FIG. 3.
Figure 13:
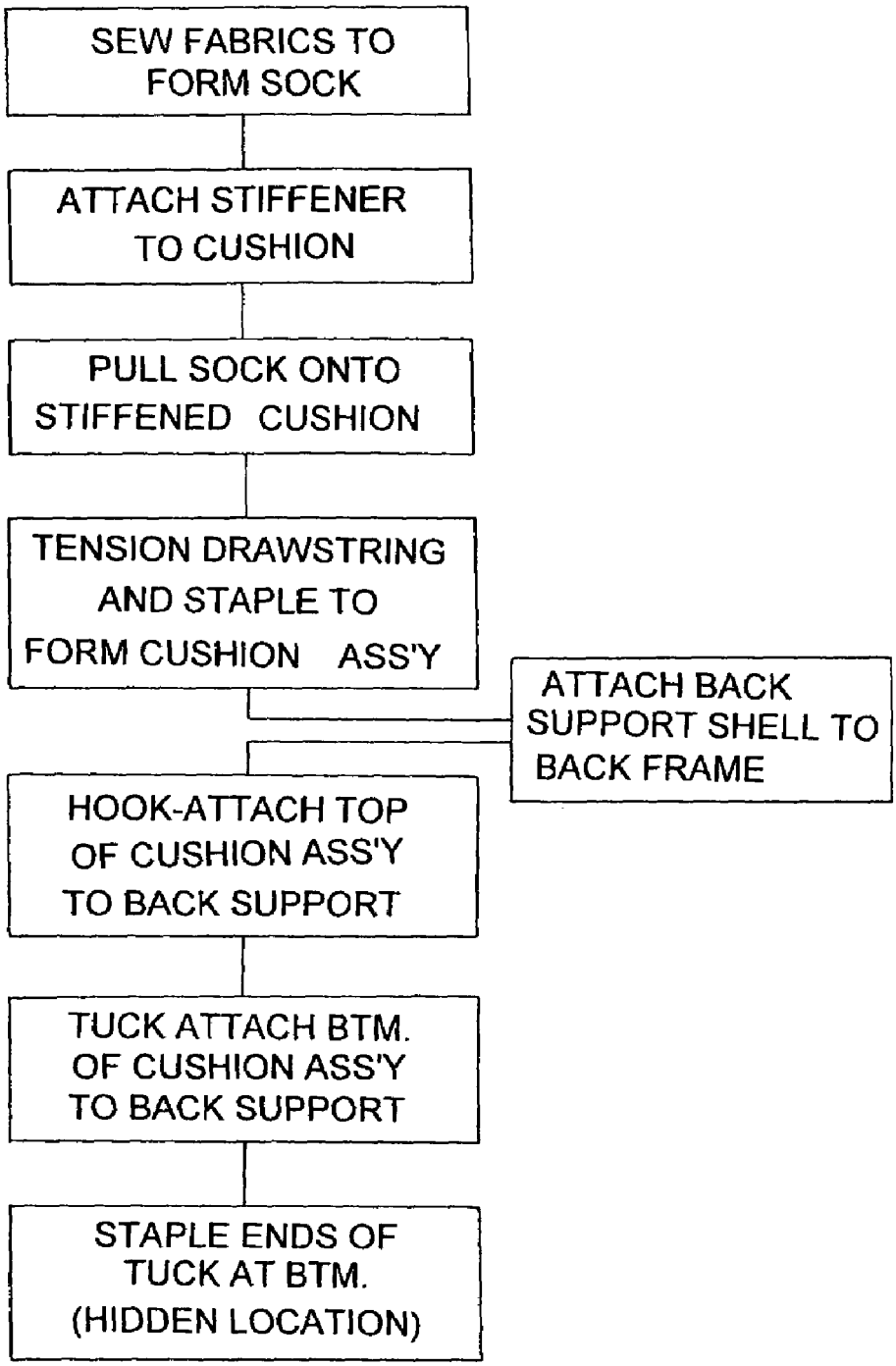
FIG. 13 is a flow diagram showing a method of assembly.

FIG. 13 discloses a method including forming a sock-like cover assembly 31 in a step 90 from the panels 32 and 33 and second fabric section 37. Step 90 further includes sewing a strip 78 to a bottom of second fabric section 37 and attaching a drawstring 80 in a tunnel 79'. A second step 91 includes attaching cushion stiffener 34 to the cushion 35. The cover assembly 31 is positioned adjacent the cushion 35 and inverted onto an end of the cushion 35 opposite the cushion stiffener 34 in a step 92. This results in the high-stretch second fabric section 37 being positioned at a lower edge of the cover assembly 31 remote from the cushion stiffener 34. The cover assembly 31 is then adjusted on the cushion 35 and cushion stiffener 34 to eliminate wrinkles and to properly position the seam lines. This may include tensioning the drawstring 80, as shown in step 93. Specifically, in the illustrated embodiment, the drawstring 80 is tensioned to draw a top of the cover assembly 31 downwardly onto the cushion stiffener 34. This also tensions the front panel 32. The tensioned drawstring 80 helps hold the cover assembly 31 in position during the steps of inserting staples 82 and 83, and during a step of setting any adhesive in the assembly. The front panel 32 is then staple-attached along its upper edge to the cushion stiffener 34 by staples 82 (FIG. 9) that extend through the wrapped-over top edge of the front panel 32 into the cushion stiffener 34. The upper edge 33' of the rear panel 33 is overlapped onto the down flange 76 and is stapled with staples 83 that extend through the upper edge into the down flange 76. Where desired, heat-activated adhesive is applied to a front surface of the cushion 35, and the adhesive is activated by steam or heat to adhere the front panel 32 to the cushion 35. This assembly results in cushion assembly 28.

The back support shell 27 of the back construction 24 (FIG. 13) is attached in a step 94 to the back frame 22 by screws at the top connection 44 and by pivot studs at the bottom connection 45. A lumbar force adjusting device 95 (FIG. 1) is attached to the back frame 22 to bias the flange 47 of belt bracket 46, such that the lumbar section 43 of the back support shell 27 naturally is biased to a forwardly concave shape.

The cushion assembly 28 is assembled onto the back support shell 27 in a step 96 (FIG. 13) to form the back construction 24 by abutting stops 62' on the cushion stiffener 34 against the stops 62' on the back support shell 27, and by extending the hooks 58 on the thoracic section 41 of the back support shell 27 into the apertures 75 of the cushion stiffener 34. Then, the back cushion 35 including the cushion stiffener 34 is moved downwardly to frictionally engage the hooks 58. Thereafter, the stiffened edge flange 39 at the bottom of the rear panel 33 is stretched, rolled 180 degrees, and tucked upwardly into the downwardly facing horizontal recess 49 on the back support shell 27 (in a step 97). The stiffened edge flange 39 is tucked into position from one side to another with a "zip-lock" type motion. After it is fully inserted, the side edges of the high-stretch second section 37 are pulled back, and a staple is extended through the stiffened edge flange 39 into each end of the rear lip 50 in a step 98. The high-stretch second section 37 is then pulled laterally out to a wrinkle-free condition where it hides these end-located staples. Notably, the high-stretch second section 37 is a dark or black color and is located behind the seat 23 below the back construction 24 in the shadow of the back construction 24, such that the bottom connection 30 including the enlarged section 48 of the back support shell 27 is not easily visible to a person standing in or around the chair 20.

Figure 11:
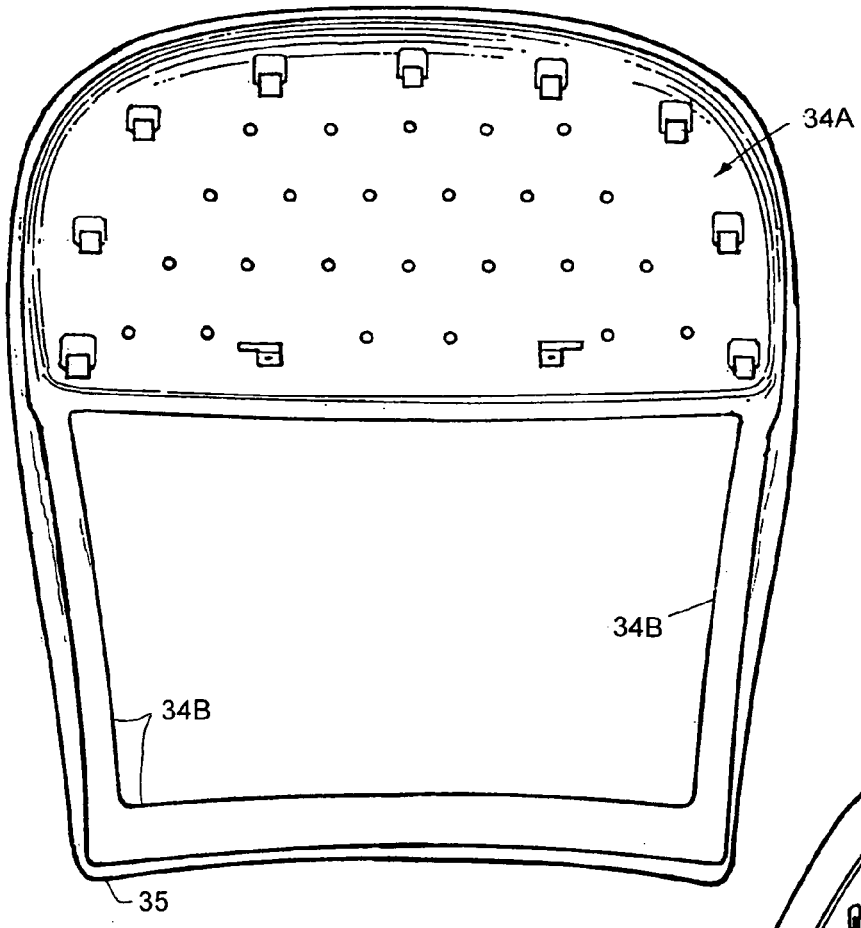
FIG. 11 is a rear view of a modified cushion assembly similar to that shown in FIG. 9, but with edge stiffener legs extending downwardly along side edges of the cushion pad.
Figure 12:
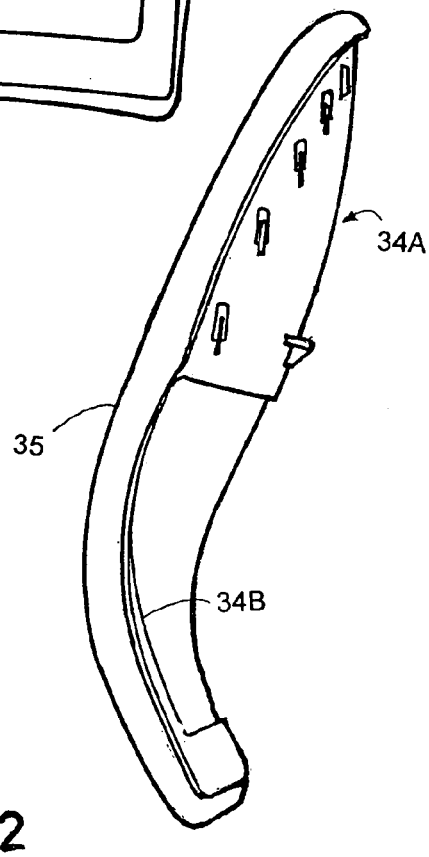
FIG. 12 is a side view of the modified cushion assembly shown in FIG. 11.

In the embodiment of FIGS. 11 and 12, a modified cushion stiffener 34A is provided that includes an upper portion like the stiffener 34, but further includes perimeter bands 34B that extend down side edges and along a bottom of the cushion 35 to stiffen the edges completely around the cushion 35. Cushion stiffener 34A is desirable where the fabric panels 32 or 33 are so strong as to overpower the cushion edges causing wrinkling.

As noted above, the cushion 35 is made from a recycled non-woven PET fibrous mat supplied by Sackner Co., Grand Rapids, Mich. The PET mat is molded to form a novel cushion that is substituted for the polyurethane cushion and the topper cushion often used in prior art. Non-woven polyester or PET is a polyester with a phenylene group in a chain. The stiffness of this chain is what allows the thermoplastic to perform surprisingly and unexpectedly well as a cushioning fiber, as discussed below.

When PET completely burns, it turns into carbon dioxide and water and does not emit any poisonous gases. Food products can be packaged in this material without any worry, and containers can be burned without the need for extraordinary emission control measures. This is not true for polyurethane, which will emit dangerous byproducts when burned. Use of PET material is also environmentally friendly. A major source of the PET material for cushion 35 comes from re-ground pop bottles. Recycling of PET pop bottles into headliner cores, insulation, and door panels has apparently been previously done. However, its use as a complete cushion for a chair seat or chair back has not been done to my, the inventor's, knowledge.

Figure 14:
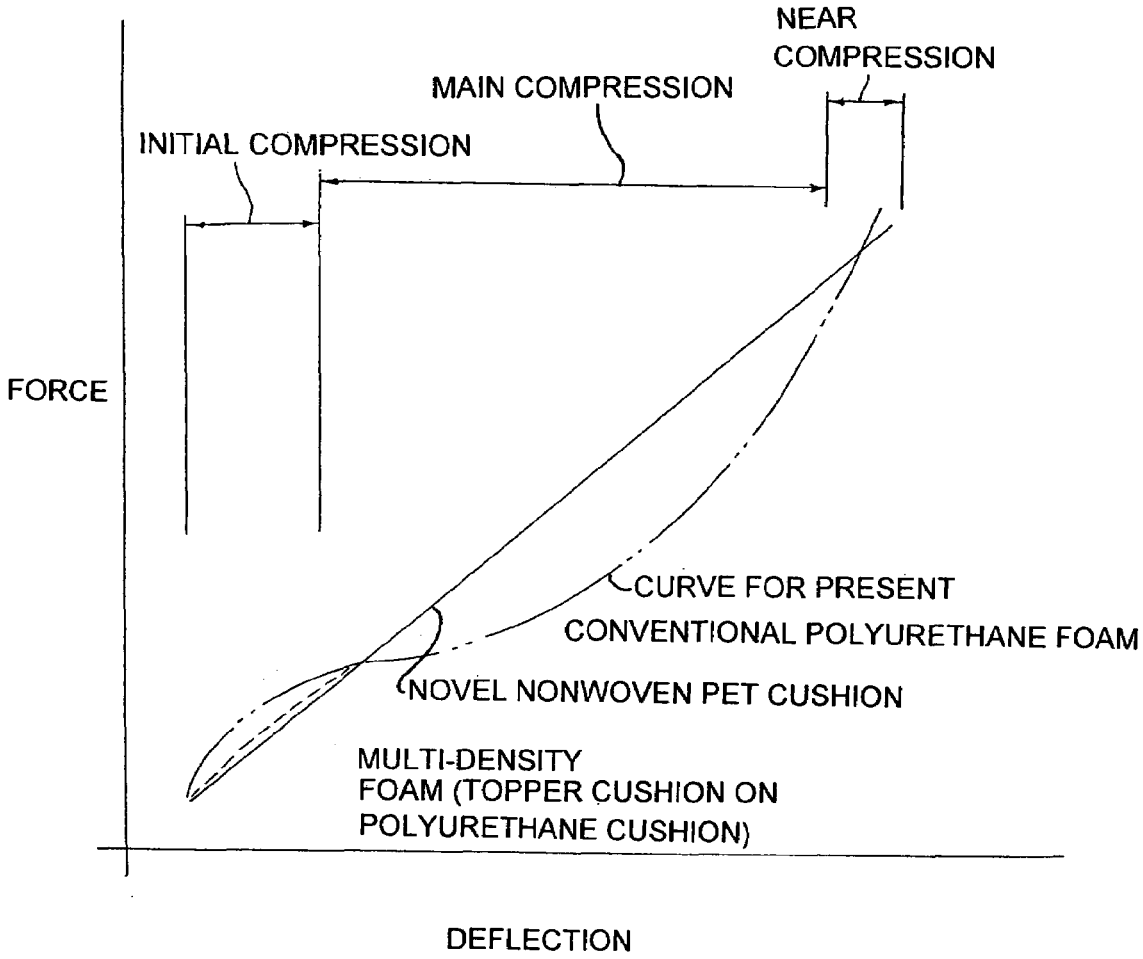
FIG. 14 is a force versus deflection curve comparing the novel cushion of non-woven PET fibers to a conventional polyurethane foam cushion.

A major advantage of the PET cushion material are that it is 15 to 20 percent lighter than polyurethane foam, yet it provides a high value and high value per unit cost. Further, the PET cushion material provides improved comfort to a seated user including a very uniform force versus deflection curve (see FIG. 14) with a surprisingly constant slope over a major portion of its compression. The more conventional polyurethane foam has a much less constant rate of compression. Often a topper cushion (e.g., about a ¼-inch thick cushion) is placed on a main cushion (e.g., about a 1-inch thick cushion) to "smooth out" the initial compression of the main cushion. However, this adds considerable expense. The non-woven fibrous cushion 35 does not need any such topper cushion. Further, the PET cushion material provides more breathability including the ability to wick away a seated user's sweat, provides excellent fatigue resistance and long life with little or no generation of dust after extended time in service, provides a capability of easy and low-cost recycling, and has no carcinogens or VOC's in its manufacture. Further, my initial research indicates that replacing molded foam with an equivalent piece of PET cushion results in a break-even or a decrease in costs.

Thermal comfort studies done by or for Steelcase, the assignee of the present invention, indicate a 50 percent higher/greater moisture permeability index in the supplied PET cushion than molded urethane foam cushions. This is believed to be due to the more open internal (fibrous) structure of the PET material. Higher index numbers equate to more desirable comfort. Also, the evaporative resistance of the PET cushion is less than half that of the molded foam cushion. The lower evaporative resistance correlates to improved comfort also in that the moisture given off by the body is absorbed and dispersed through the PET cushion much faster than through the molded urethane cushion.

Testing of the PET and molded urethane foam, using tests known to persons skilled in making chairs, indicates a lower initial load deflection characteristic of the PET cushions over the more traditional urethane foams, but a higher support factor, better ball rebound, better tensile strength and elongation, and a more linear cushioning rate. Tests suggest the feel to be more "residential" verses "industrial" (see FIG. 14).

Advantageously, the non-woven PET cushion can be formed into a three-dimensional shape to conform properly to a particular chair geometry. Leaving the material in a flat shape and attaching it to the chair can result in a "kinking" of the PET material in some highly contoured chair designs, which may telegraph a crease or wrinkle into the face fabric of these chairs.

My proposed system works as follows. For the seat 23 of chair 20, batting of material is optimally produced to a known raw mat density and thickness, such as about 2.3 to 2.6 lb./ft$^3$, with a thickness of about 2 inches (unformed) or about 2.3 to 3.5 lb./ft$^3$ density (or more preferably between about 3.1 to 3.5 lb./ft$^3$) with a thickness of about 1½ inches (formed). A similar density of about 2.3 to 2.6 lb./ft$^3$ is used for back cushion 35, but the thickness is different. For example, in cushion 35 the thickness is about 1 inch (unformed) or about 2.3 to 5.2 lb./ft$^3$ density (or more preferably between about 4.6 to 5.2 lb./ft$^3$) with a thickness of about ½ inch (formed). The material is cut to a predetermined size with a die cut, laser cut, or any other efficient means of trim. This pre-form is then loaded into a three-dimensional aluminum tool cavity of the desired shape. The cavity and lid are both pre-drilled to allow steam to pass through the tool halves. The material is then introduced to about a 30 second (plus or minus 5 to 10 seconds) steam heating cycle of about 250 degrees Fahrenheit that breaks the temporary thermal adhesive bond, and a 10 second (plus or minus 5 seconds) cooling cycle of ambient air that allows the material to rebond in the desired three-dimensional shape. The memory of the material is thus changed to the new shape and the part is removed from the tool. Since no edge trimming is required, edges can be produced round, and since the edges are not trimmed, edges do not have a hard edge or look non-uniform. Less handling and sensitive trimming also result in reduced costs of manufacture. Also, there is no scrap in terms of flashing or trimmings from the forming process, and any scrap, if generated, can be recycled.

The compressibility and shape of the cushion is also more uniform, since a uniformly produced batting of material, cut to a controlled size, was loaded into the tool and no materials were discarded in the forming process. Feature lines, depressions, and the like can be molded or pressed into the cushion material. Characteristically, no flash lines or parting lines are formed, such that the marginal material around a perimeter of the part feels the same as (and has the same density and compressibility as) the main part of the cushion.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A seating unit comprising:

a base;

a seat support supported by the base;

a back upright operably supported on the base for movement between an upright position and a reclined position;

a back construction including a back support attached to the back upright;

a cushion supported by a surface on at least one of the back support and the seat support, the cushion having opposing side edges; and an edge stabilizer extending along the opposing side edges and attached to the side edges to control a position of the side edges relative to the one support, with the opposing side edges being unattached and movable in at least one direction on the one support, wherein the one support is the back support, wherein the cushion and the edge stabilizer form a cover assembly, and wherein the back support includes first bands located along its edges, and the edge stabilizer includes second vertical bands that extend along the opposing side edges of the cushion, the second vertical bands engaging the first vertical bands but being unattached thereto along a majority of the first vertical bands.

2. The seating unit defined in claim 1, wherein the edge stabilizer includes a bottom connector attached to the back support.

3. A seating unit comprising:

a base;

a seat support supported by the base;

a back upright operably supported on the base for movement between an upright position and a reclined position;

a back construction including a back support attached to the back upright;

a cushion supported by a surface on at least one of the back support and the seat support, the cushion having opposing side edges; and an edge stabilizer extending along the opposing side edges and attached to the side edges to control a position of the side edges relative to the one support, with the opposing side edges being unattached and movable in at least one direction on the one support, wherein the edge stabilizer includes a top section, opposing vertical side bands and a horizontal bottom band extending around a perimeter of a bottom portion of the cushion and attached to at least the bottom portion of the cushion.

4. The seating unit defined in claim 3, wherein the one support is the back support.

5. The seating unit defined in claim 4, wherein the cushion and the edge stabilizer form a cover assembly.

6. A back construction comprising:

back support including a lumbar region adapted to support a seated user;

a cover supported by the back support, the cover having opposing side edges extending vertically along a front surface of the back support but not attached to the back support along a majority of the lumbar region; and an edge stabilizer attached to the side edges and abuttingly supported on the back support to control a position of the side edges relative to the back support in the lumbar region but allowing the opposing side edges to move in at least one direction on the back support, whereby forces on the cover result in controlled movement rather than uncontrolled shifting of the cover assembly, wherein the back support includes first vertical bands of material in the lumbar region and also a flexible region in the lumbar section therebetween, and wherein the edge stabilizer includes second vertical bands of material that abuttingly slidably engage the first vertical bands.

7. The back construction defined in claim 6, wherein the cover includes a panel of upholstery material.

8. The back construction defined in claim 6, wherein the cover includes a cushion.

9. A back construction comprising:

a back support including a lumbar region adapted to support a seated user;

a cover supported by the back support, the cover having opposing side edges extending vertically along a front surface of the back support but not attached to the back support along a majority of the lumbar region; and an edge stabilizer attached to the side edges and abuttingly supported on the back support to control a position of the side edges relative to the back support in the lumbar region but allowing the opposing side edges to move in at least one direction on the back support, whereby forces on the cover result in controlled movement rather than uncontrolled shifting of the cover assembly, wherein the edge stabilizer includes vertically-extending bands of material extending along and attached to the side edges of the cover.

10. The back construction defined in claim 9, wherein the edge stabilizer is a structural component having a stiffness greater than the cover.

11. The back construction defined in claim 9, wherein the edge stabilizer includes a horizontal band of material extending between the vertically-extending bands, the vertically-extending bands and horizontal band extending along a perimeter of a bottom portion of the cover.

12. The back construction defined in claim 11, including a bottom connector attached to the horizontal band and connected to the back support.

13. A back construction comprising:

a back support configured to support a seated user and including vertically-extending edge sections and a flexible region between the edge sections where the seated user is more flexibly supported than at the edge sections; and a cover assembly supported by a front surface of the back support, the cover assembly including opposing side edges unattached to but supported by the edge sections of the back support, the cover assembly also including an edge stabilizer extending along and attached to the opposing side edges along at least a majority of the edge sections, the edge stabilizer being sufficiently structural to control a position of the side edges relative to the edge sections, wherein the cover assembly includes vertically-extending bands adapted to shift vertically along with the side edges of the cover assembly to reduce a tendency to undesirably distort the side edges of the cover assembly upon receiving a distorting force acting on the face of the back support.

14. A back construction comprising:

a back support configured to support a seated user and including vertically-extending edge sections and a flexible region between the edge sections where the seated user is more flexibly supported than at the edge sections; and a cover assembly supported by a front surface of the back support, the cover assembly including opposing side edges unattached to but supported by the edge sections of the back support, the cover assembly also including an edge stabilizer extending along and attached to the opposing side edges along at least a majority of the edge sections, the edge stabilizer being sufficiently structural to control a position of the side edges relative to the edge sections, wherein the edge stabilizer includes a horizontal band of material defining a bottom edge extending between the opposing side edges, the horizontal band being attached to the cover assembly.

15. The back construction defined in claim 14, wherein the back support comprises a back shell.

16. The back construction defined in claim 14, wherein the edge stabilizer comprises a molded polymeric material.

17. The back construction defined in claim 14, including a first connector at the bottom edge and a mating connector on the back support releasably engaging the first connector.

18. The back construction defined in claim 14, wherein the cover assembly includes an upholstery front panel covering a cushion.

19. A back construction comprising:

a back support configured to support a seated user and including vertically-extending edge sections and a flexible region between the edge sections where the seated user is more flexibly supported than at the edge sections; and an upholstered cushion assembly supported by a front surface of the back support, the cushion assembly including opposing side edges unattached to but supported by the edge sections of the back support, the cushion assembly including a cushion, an edge stabilizer including a U-shaped strip that extends around the bottom and the side edges of the cushion, and the edge stabilizer attached to the cushion at least along bottom and side edges of the cushion, the edge stabilizer being sufficiently structural to control and stabilize a position of the side edges of the cushion relative to the edge sections of the back support.

20. The back construction defined in claim 19, wherein the front surface of the back support does not protrude forwardly along the edge sections to restrict lateral movement of the cushion assembly.

* * * * *